US010597123B2

(12) United States Patent
Bell

(10) Patent No.: US 10,597,123 B2
(45) **Date of Patent: *Mar. 24, 2020**

(54) ELECTRONICALLY POWERED ILLUMINATING FIN SYSTEM FOR WATERSPORTS INVOLVING BOARDS

(71) Applicant: R. Brandon Bell, West Palm Beach, FL (US)

(72) Inventor: R. Brandon Bell, West Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/950,238

(22) Filed: Apr. 11, 2018

(65) Prior Publication Data

US 2018/0229820 A1 Aug. 16, 2018

Related U.S. Application Data

(63) Continuation of application No. 15/419,035, filed on Jan. 30, 2017, now Pat. No. 9,969,469.

(51) Int. Cl.

| | |
|---|---|
| ***B63B 35/79*** | (2006.01) |
| ***F21S 4/28*** | (2016.01) |
| ***F21S 9/02*** | (2006.01) |
| ***F21V 23/06*** | (2006.01) |
| ***F21V 31/00*** | (2006.01) |
| ***H05B 33/08*** | (2020.01) |
| ***H05B 37/02*** | (2006.01) |
| ***B63B 45/00*** | (2006.01) |
| *F21W 107/20* | (2018.01) |
| *F21Y 103/10* | (2016.01) |
| *F21Y 115/10* | (2016.01) |
| *F21W 102/00* | (2018.01) |

(52) U.S. Cl.

CPC ..... *B63B 35/7926* (2013.01); *B63B 45/00* (2013.01); *F21S 4/28* (2016.01); *F21S 9/02* (2013.01); *F21V 23/06* (2013.01); *F21V 31/005* (2013.01); *H05B 33/0845* (2013.01); *H05B 33/0857* (2013.01); *H05B 37/0272* (2013.01); *F21W 2102/00* (2018.01); *F21W 2107/20* (2018.01); *F21Y 2103/10* (2016.08); *F21Y 2115/10* (2016.08)

(58) Field of Classification Search

CPC ..... B63B 35/73; B63B 35/79; B63B 35/7906; B63B 35/7926; B63B 35/793; B63B 35/7933; B63B 35/7909; B63B 35/85; B63C 11/00; B63C 11/49; F21S 4/28; F21S 9/02; F21V 23/06; F21V 31/005; H05B 33/0845; H05B 33/0857; H05B 37/02; H05B 37/0272

USPC ..... 441/74, 79, 80

See application file for complete search history.

(56) References Cited

U.S. PATENT DOCUMENTS

| | | | | |
|---|---|---|---|---|
| 5,464,359 | A | 11/1995 | Whitty | |
| 7,238,075 | B2 | 7/2007 | Brodsky | |
| 9,969,469 | B1 * | 5/2018 | Bell | B63B 35/7926 |

(Continued)

*Primary Examiner* — Lars A Olson

(74) *Attorney, Agent, or Firm* — Lambert Shortell & Connaughton; Gary E. Lambert; David J. Connaughton, Jr.

(57) ABSTRACT

An electronically powered, light emitting fin used with a surfboard or paddleboard, or similar water sports board. The fin is configured to be attached to the water sports board to provide illumination under the board when using the device. The lighted fin may be particularly useful when using the water sports board at night to illuminate water beneath the board.

19 Claims, 5 Drawing Sheets

(56) References Cited

U.S. PATENT DOCUMENTS

2009/0042467 A1* 2/2009 Huang ..... B63J 2/00
441/74
2016/0224227 A1* 8/2016 Brush ..... G06F 3/04847

* cited by examiner

ELECTRONICALLY POWERED ILLUMINATING FIN SYSTEM FOR WATERSPORTS INVOLVING BOARDS

BACKGROUND OF THE INVENTION

Field of the Invention

This invention pertains to an electronically powered, illuminating fin which may be used in any of the various water sports involving paddle boards and surfboards. More particularly a battery powered fin, or skeg, which is easily transportable and interchangeable between boards, using high powered LED lights for underwater lighting benefiting the user with additional visibility at night, and also illuminating the water below for an overall enhanced experience.

Description of Prior Art

The fin of a surfboard has existed since some of the early surfboards, as it was a necessity to maintain a specific direction while traveling over water. While the shape of the fin has evolved and diversified in modern times due to increased demand for specific performance characteristics, that is practically all that has changed from the initial beginnings as a simple piece of wood. Fins are interchangeable and made of a variety of materials, but there is no additional purpose or other variation. The interchangeability of the fin is easy for the user to do.

In recent years, the sport of paddle boarding and surfing have grown in popularity. Especially so in the sport of paddle boarding which exists across a large group of people due to its ease of use on any body of water rather than requiring an ocean swell and all other associated difficulties and dangers that exist in surfing.

Previously, prior art has shown a design which incorporates electronic powered lights into the various boards themselves. This method is expensive and requires the user to purchase an additional board or pay additional installation fees on top of the equipment cost. It is not easily transportable because the boards are approximately 10 feet long. When transportation is required, it is costly especially via common airline. The illumination under the board enables the user to view the immediate surroundings. This method may include lights on the bottom, but again requires a very specific and costly type of board.

Other commonly used methods for underwater illumination in paddle boarding include small light fixtures which may attach with suction cup. Additional methods show a battery pack and a long strip of LEDs or similar attached. While these methods prove to be effective draw backs include increased drag with the addition of each suction cup light or light strip and its associated drag and costs. Additional difficulties arise with the addition of a battery and light strip the board itself. Some difficulties include increased drag under water, less space on the deck of the board and additional to components to be aware of and overall size. The strip light systems are currently costly relative to the suction cup counter parts and require additional skill and labor for assembly. They are often undesirable to attach on expensive, high performance boards and require work above and beyond the general scope of traditional paddle boarding.

The use of lights in paddle boarding especially has shown the need for a design to allow the user to reduce drag underneath the board with the addition of lights and also keep the system affordable, easy to use and transport on any board. Increase in popularity combined with other advances in modern electronics has left a void in various sports such as the abovementioned. Research shows there currently is not a battery powered, illuminating fin design. The increased desire to enhance experiences with lights, safety on the water in low light situations and personal photography has created a need for a light up fin having the following characteristics and benefits over prior art.

SUMMARY OF THE INVENTION

The subject matter of this application may involve, in some cases, interrelated products, alternative solutions to a particular problem, and/or a plurality of different uses of a single system or article.

It is an object of the present invention to provide a seamless way to incorporate lights onto the fin of a board used in surfing or paddleboarding. It is another object of the system to create an easily transferable and transportable fin system to illuminate the water below a board for personal water sport use.

The present invention utilizes an already existing and familiar structure, the fin. The addition of lights to the fin of the board creates a system of easy integration as there is seemingly nothing added to the board which already has fins. The combination is unique and there is no previous evidence of its design in prior art. In some embodiments, the fin comprises of a compartment to hold the power source which may be a battery. For example, there may be a detachable cover to allow removal of the battery which is encased in a waterproof chamber. The compartment is sealed with a gasket and cover which may be screw type or clamp type. The battery source may be of disposable type or rechargeable type including but not limited to lithium ion, common store bought brand and similar. It should be understood however that the power source may be any source capable of providing power to the light source. This power source may be within the fin, on the water sports board, or external.

The perimeter of the fin is comprised of a row of lights pointing in an outward direction. In one aspect of the present invention, there may be a waterproof strip of LED's used for illumination. The LED's may be powered by a battery. The lights may have a switch to easily turn on and off. The switch may be on the fin, the board to which the fin is attached, or may be on a separate remote controller. The light strip may be connected to the fin body in any manner. In a particular embodiment, the strip may be fitted to the fin body by a tongue and groove mating arrangement.

In yet another aspect of the present invention, the LED's may be encased in a sheath thus making them waterproof. The LED's may be powered by a battery with or without a switch to control power. The sheath may allow interchangeability of lights allowing a plurality of colors and intensities/brightness to be used. In similar aspects, a lens may be positioned over one or more of the lights on the fin to magnify, focus, scatter, or otherwise adjust the light depending on desired features.

In another aspect of the invention the illumination source may be some form of fiber optic cable in addition to, or instead of LED lights to create yet another form of illumination.

In yet another aspect of the invention, the fin may be equipped with micro controller to allow various combination of color and pulsation of intensity. This controller may, in other embodiments, provide other control and features of the system. For example, in one embodiment, a low battery alarm may be initiated by the controller upon determination that the battery power source is running low. The lights and associated color and pulsation may be used for emergency signaling, identification purposes and also to conserve battery.

In another aspect of the invention, there may be an attachment for the lights and battery pack that allows it to be easily removed on a fin. The attachment may consist of hook and loop style adhesive, clamping, press fit or traditional bolt and nut hardware method.

In yet another aspect of the invention, the fin may be constructed of transparent materials allowing an encased illumination source to create a glowing fin.

In another aspect, the fin may be constructed out of two halves for ease of assembly and cleaning. The two halves may attach by various hardware, snap in place or screw type clamp.

In yet another aspect of the invention, various woven composites may be used to construct the main fin body with a resin matrix system.

In yet another aspect the fin may use an adapter to integrate into an existing fin system. A method for attachment may include strap, elastic rope, Velcro or other common method.

In another aspect of the invention, there may be a microcontroller used to control light intensity, color and to control a change in color pattern. The controller may or may not be control via remote control.

In yet another aspect of the invention, a removable waterproof insert may be used. The insert may removably fit to an open center portion of the fin and house the necessary electronics to provide illumination. Additionally, the center insert may be clear to provide additional light emission from the center. The insert may be removable while leaving the rest of the fin in place for ease of replenishing the power supply.

It should be understood that the illuminating fin and related elements may be of varying size and shape without straying from the scope of the present invention.

BRIEF DESCRIPTION OF THE DRAWINGS

Embodiments of the present invention will now be described by way of example only, with reference to the attached figures wherein.

DETAILED DESCRIPTION

Figure 1:
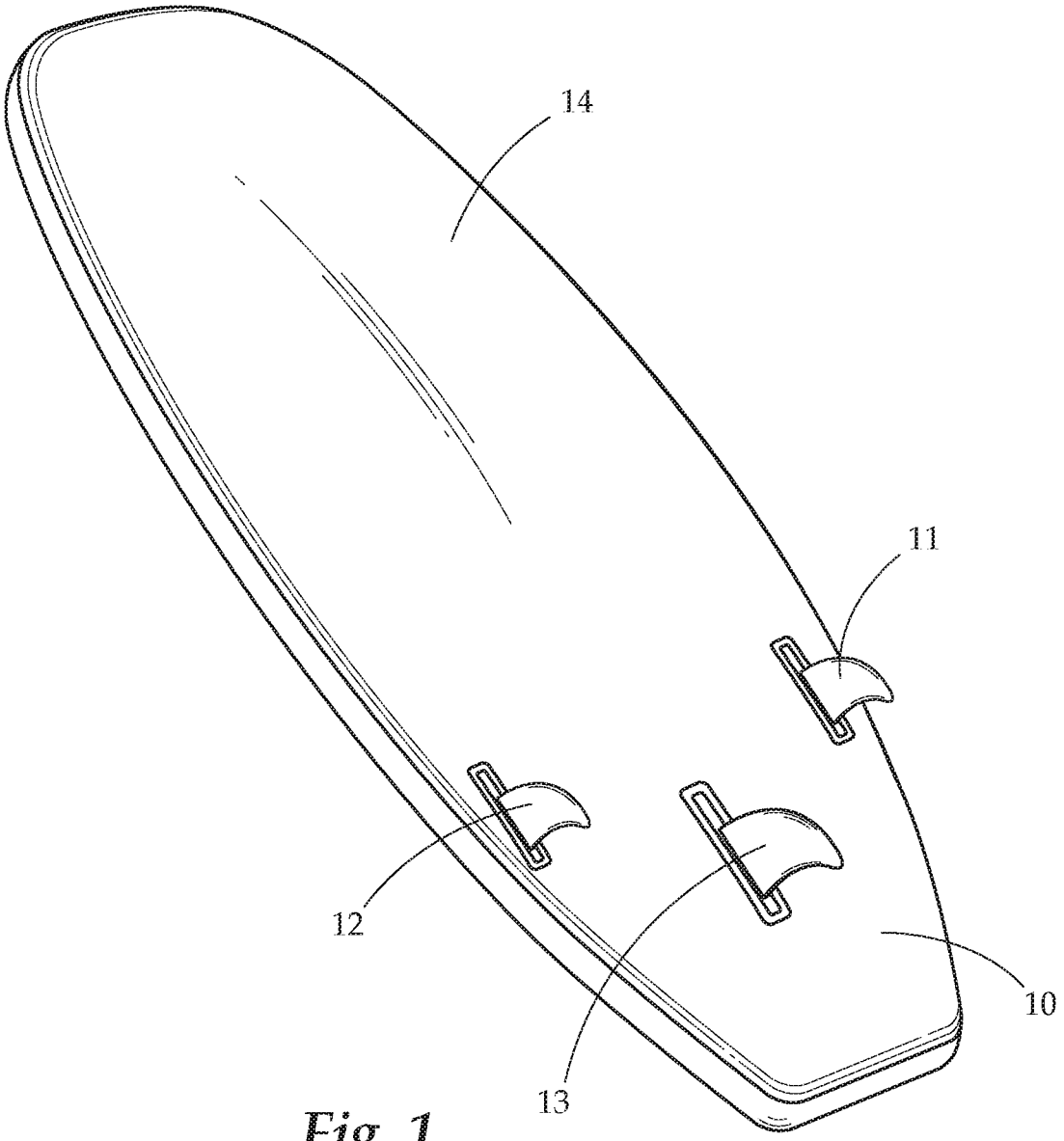
FIG. 1: Provides a perspective view of the present invention illuminating fin installed on a water sports board.

The sport of paddle boarding as contemplated in the present invention involves the use of a board having a fin or set of fins. The fin(s) attach to the bottom of the paddleboard and are held in place typically with a setscrew to draw and hold in the attachment point. As the paddleboard is propelled through the water the fins help maintain a direction controlled by the paddler and provide stability.

The fins typically are made of a hard, durable plastic, or in other common instances, a composite with resin. The fins may vary in size, shape and color for various performance and aesthetic reasons. Common arrangement of the fin or fins includes a larger center fin which may or may not have two additional fins. The two additional fins sit in parallel sitting slightly closer towards the front and near the outer edges. The tri fin setup resembles a triangular setup in nature. There is some performance to be gained with the tri fin setup, however for most calm water conditions a single fin offers plenty of control for most users. This is the traditional practice utilized and largely inherited from the sport of surfing since inception.

Today current innovation has allowed for fins to be produced by various methods. Additionally, current innovation has allowed for various improvements in electronics. The resulting combination of advanced manufacturing methods and improvements in electronics has allowed for the present invention to improve the sport of paddle boarding and associated user experience.

The invention described herein can allow the user to paddleboard at night while maintaining optimal fluid dynamic properties of the paddleboard and improving visibility to one self and others on the open water. The invention described is easily transportable from one destination to another and is easily installed on various watersports boards. In many embodiments, the fin may be removably attachable to the paddle board. For example, the light up fin of the present invention may attach to a water sports board using existing connection systems which allow for removable attachment of paddle board fins. An advantage to this removable attachment is the ability for a user to easily transfer the fin from one board to another. This can allow, for example, simple conversion of a rented board to a lighted board without the need to bring a particular board on a trip. The removable attachability allows enhanced portability for travel, convenience and the like.

In one example, testing in the intracoastal waterways of Miami, Fla. proved that the fins can illuminate the water surrounding at least a portion of the paddle board by up to approximately 20 feet. Water visibility was slightly murky yet the illuminating fins allowed the paddleboard to be easily spotted from shore several hundred feet away. In yet another example of testing in Hawaii, early designs of the fin allowed the user to view the corals just a few feet underwater and attracted several small fish within minutes, providing an exciting exploratory experience for the user.

FIG. 1 show a paddle board 14 fin system generally located at rear bottom surface 10. The fin system is comprised of a main center fin 13 and two optional fins 11 and 12 attached to paddle board 14. The illuminating fin may be center fin 13 and/or fins 11 and 12.

Figure 2:
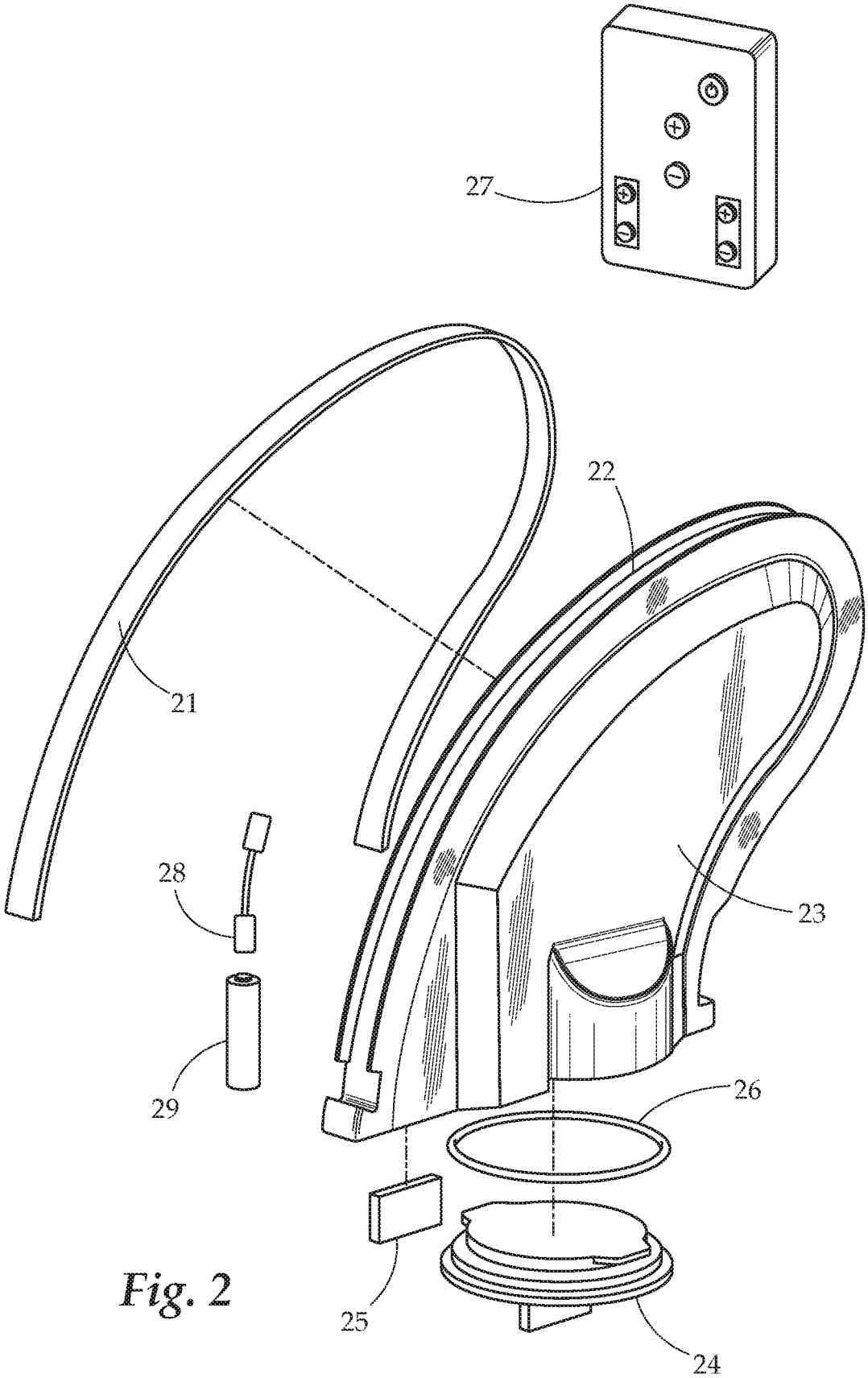
FIG. 2: Provides a partially exploded perspective view of an embodiment of the present invention.

FIG. 2 shows the illuminating fin assembly with 23 representing the fin body. LED light strip 21 is installed into groove 22 on the perimeter of the fin 23. LED light strip 21 may contain any number of LEDs and also capable of various color and being powered by various voltages. In other embodiments, alternative light arrangements may be used without straying from the scope of this invention. Twist lock cover 24 attaches to fin body 23 and compresses o-ring 26 in the assembly to provide a waterproof seal. Twist lock cover 24 utilizes an integrated board attachment point that also is used as leverage for the user to open and close the twist lock cover 24. It should be understood however, that different arrangements for providing access to the interior of the fin body 23 without straying from the scope of the present invention. Second board attachment point 25 is inserted permanently to fin body 23 if it is not already an extension of fin body 23. Remote control 27 is used as an on/off switch in addition to controlling color, brightness and variation of color such as color change, strobe effect, a pulsing of the lights, and the like. Remote control 27 is interfaced with wireless receiver 28 which is connected to battery 29 and LED strip 21.

Figure 3:
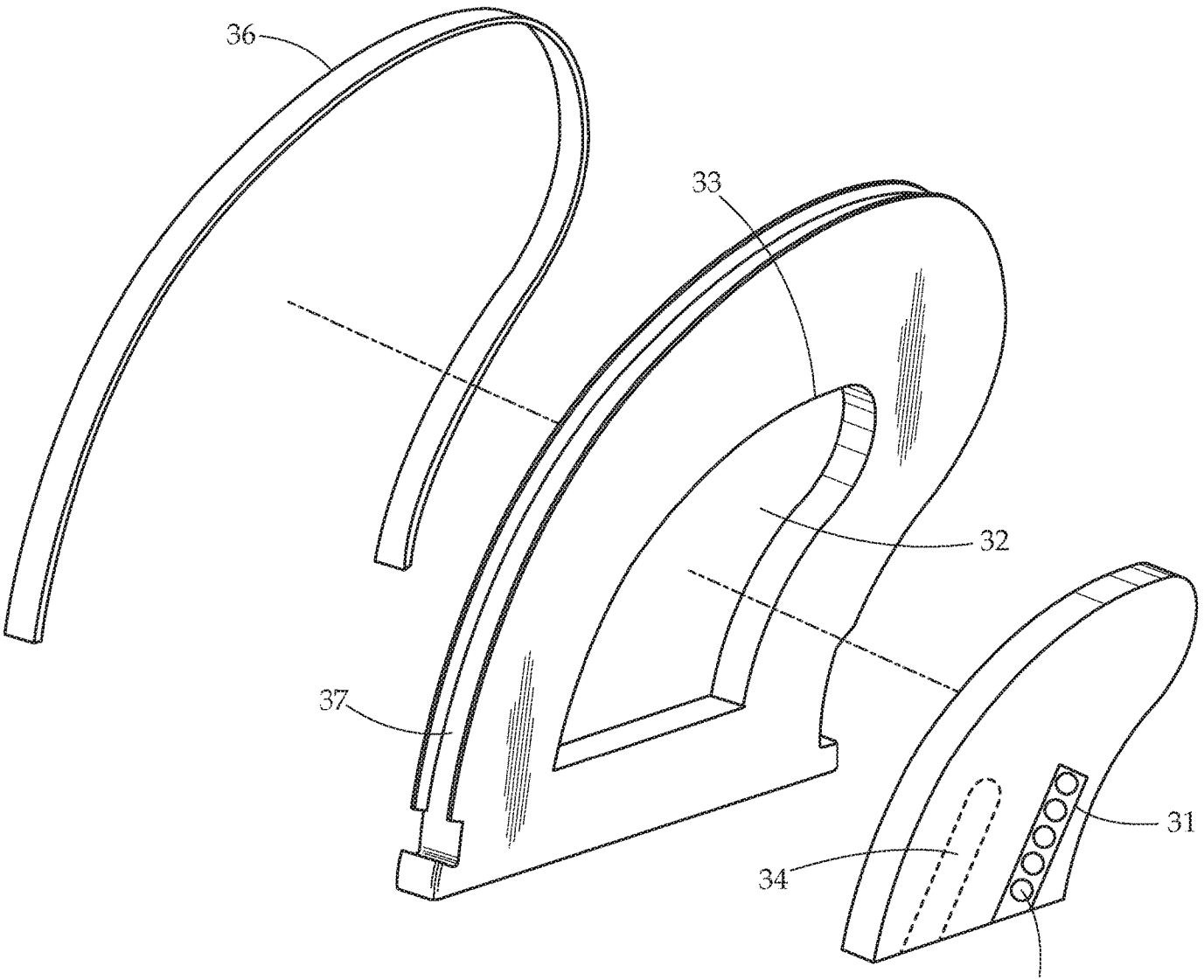
FIG. 3: Provides a partially exploded perspective view of another embodiment of the present invention.

FIG. 3 shows another embodiment of the fin having a removably attachable component portion. In this view, the fin 33 defines a central aperture portion 32 in which an insert 31 may fit. This insert, in varying embodiments, may comprise any of: additional lighting in addition to perimeter lighting, a camera, the battery or other power source, a controller or microchip, and the like. In most embodiments, insert 31 is a waterproof container that is generally clear and provides housing for battery 34 and additional LED light source 35. LED strip 36 is installed around the perimeter in groove 37 of the fin body 33. In some embodiments, a camera (not shown) may be positioned on or within the insert 31. This camera may also be placed elsewhere on the fin without straying from the present invention. In embodiments having electronic components within the insert 31, a connector may be positioned on the insert 31 to mate with a connector of the fin body 33.

Figure 4:
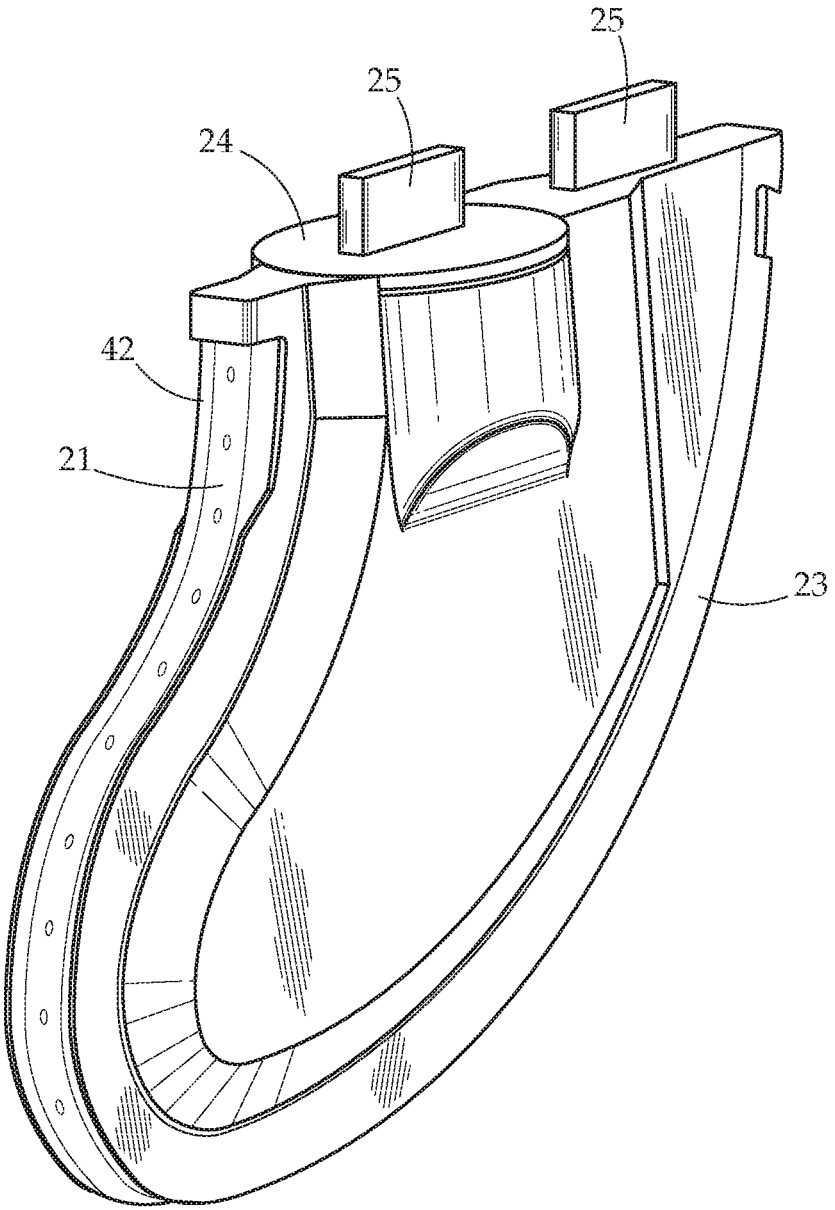
FIG. 4: Provides a perspective view of another embodiment of the present invention.

FIG. 4 provides a perspective view of another embodiment of the present invention. In this view, the top connecting area of the illuminating fin 23 can be seen. Two connectors 25 extend from the fin 23. One of the connectors 25 is at a front of the fin, and another of the connectors 25 is part of the twist lock cover 24 which seals an interior component section of the fin 23. In other embodiments, the connector 25 need not be on the twist lock cover 24 and may be positioned anywhere on the fin 23 to connect to connection structures of the water sports board. Also, the twist lock cover 24 may be substituted with any other closure structure that may seal components of the fin 23. While the two connector system is shown in this figure, it should be understood that the fin may be attached to a water sports board in any manner, without straying from the scope of the present invention. This view further shows the lighting strip 21 about the perimeter of the fin 23. A waterproof covering layer 42 covers the lighting strip 21 to prevent entry of water. In some embodiments, a camera holder or attachment area may be positioned on the fin 23 to allow connection of a camera to the fin 23, such as a waterproof camera.

Figure 5:
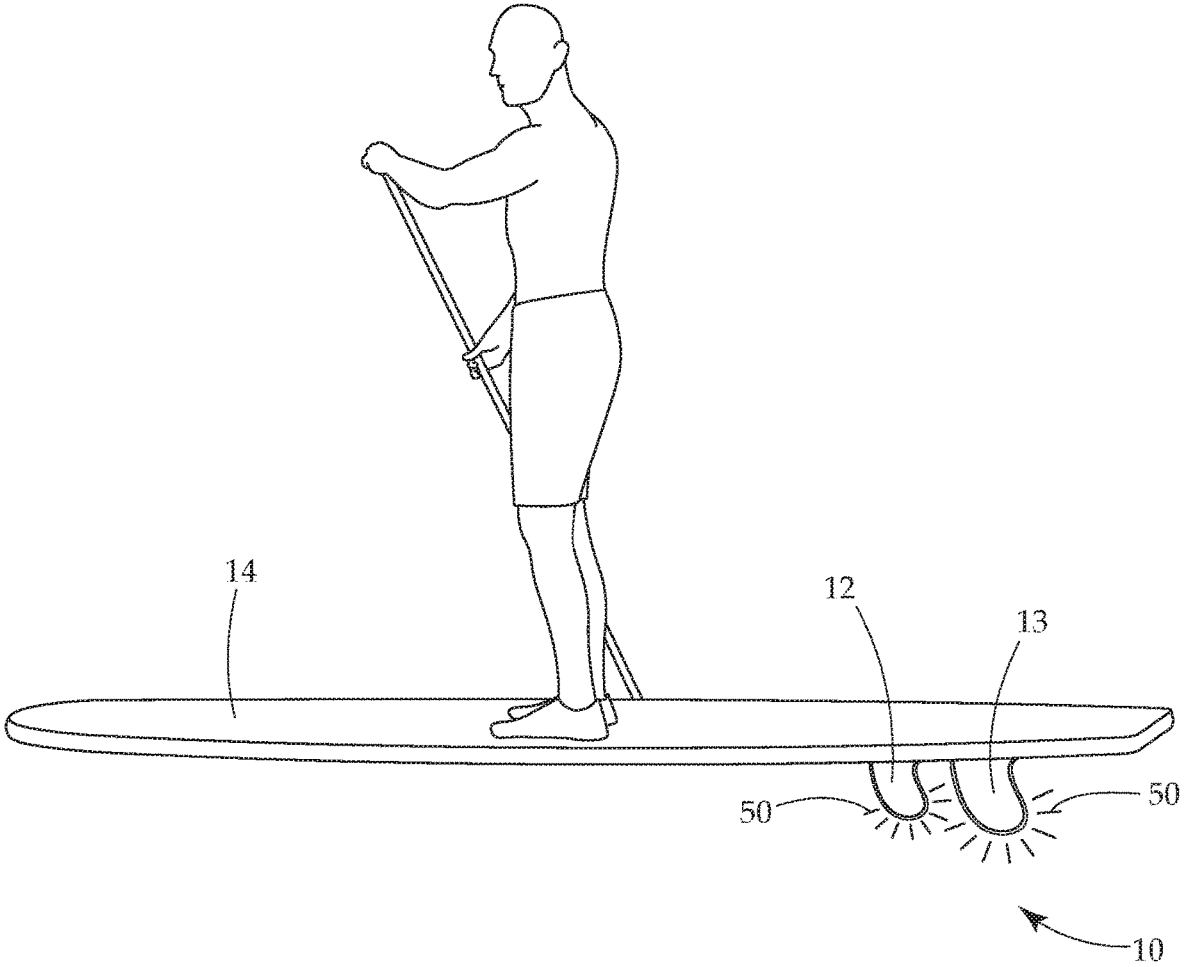
FIG. 5: Provides a view of an embodiment of the present invention installed on a water sports board in use.

FIG. 5 provides a view of the illuminating fins of the present invention in use on a water sports board. A user is standing on a paddle board 14 in this view. The board 14 comprises a front fin 50 and a rear fin 13, which are both illuminated, as indicated by light beams 50. The fins 12, 13, are mounted to a rear bottom surface 10 of the board. In an embodiment of use, a user may activate the illuminating fins to provide light underneath the water sports board. As noted above, activation may be achieved by remote control, or control on the fin or board, depending on actuation embodiments. This activation may be done before or after mounting the board by the user. Once activated, a user may use the board as normal. For example, in a paddle board embodiment, the user may paddle about, or may perform yoga, stretches, resting, and the like on the board. In a surf board embodiment, the user may ride waves, and the like.

What is claimed is:

1. A fin for a water sports board comprising:

a body having a connection area, the fin connectable to the water sports board at the connection area;

a waterproof light connected to the body, the waterproof light directed away from the body;

wherein the waterproof light is directed to illuminate an area about the fin, the area about the fin comprising the light directed to illuminate at least one of an area below that water sports board when connected to the water sports board, an area at a first side of the fin, an area at a second opposite side of the fin, and an area at a rear of the fin.

2. The fin of claim 1 further comprising a plurality of lights attached to the fin.

3. The fin of claim 1 further comprising a power source in communication with the waterproof light.

4. The fin of claim 1 further comprising a remote controller, the remote controller in wireless communication with a controller of the fin and configured to turn the light on and off.

5. The fin of claim 4 wherein the controller of the fin is configured to adjust a color of the light.

6. The fin of claim 4 wherein the controller of the fin is configured to adjust a brightness of the light.

7. The fin of claim 1 wherein the waterproof light comprises a waterproof housing.

8. A water sports board comprising a plurality of fins, at least one of the plurality of fins being the fin of claim 1.

9. The fin of claim 1 further comprising a camera positioned on the body.

10. A water sports board comprising a fin, the fin comprising:

a body;

a light directed to illuminate an area below the water sports board; and a remote controller in wireless communication with a controller of the fin.

11. The water sports board of claim 10 wherein the water sports board is one of a paddle board or a surfboard.

12. The water sports board of claim 10 wherein the light is waterproof.

13. The water sports board of claim 10 further comprising a camera positioned on the fin body.

14. A fin for a water sports board comprising:

a body, the body connectable to the water sports board;

a light connected to the body, the light directed away from the body; and a controller of the fin configured to control the light, the controller capable of wireless communication with a remote controller.

15. The fin of claim 14 wherein the controller is configured to turn the light on and off.

16. The fin of claim 14 wherein the controller is configured to adjust a brightness of the light.

17. The fin of claim 14 wherein the controller is configured to adjust a color of the light.

18. The fin of claim 14 wherein the waterproof light is directed to illuminate an area about the fin, the area about the fin comprising the light directed to illuminate at least one of an area below that water sports board when connected to the water sports board, an area at a first side of the fin, an area at a second opposite side of the fin, and an area at a rear of the fin.

19. The fin of claim 14 further comprising a camera positioned on the body.

* * * * *